US005727325A

United States Patent [19]

Mussell

[11] Patent Number: 5,727,325

[45] Date of Patent: Mar. 17, 1998

[54] MULTIPURPOSE SQUARE

[76] Inventor: Barry D. Mussell, 155 Charlotte Blvd., Stockbridge, Ga. 30281

[21] Appl. No.: 646,081

[22] Filed: May 7, 1996

[51] Int. Cl.[6] ..... B43L 7/027

[52] U.S. Cl. ..... 33/429; 33/476; 33/481

[58] Field of Search ..... 33/42, 417, 423, 33/429, 474, 476, 481

[56] References Cited

U.S. PATENT DOCUMENTS

| | | | |
|---|---|---|---|
| 1,135,259 | 4/1915 | Cokely | 33/481 |
| 1,255,429 | 2/1918 | Killion | 33/429 |
| 4,404,753 | 9/1983 | Klok | 33/474 |
| 4,420,891 | 12/1983 | Orem | 33/476 |
| 4,513,510 | 4/1985 | Swanson | 33/419 |
| 4,574,492 | 3/1986 | Miller | 33/376 |
| 4,736,525 | 4/1988 | Deason | 33/474 |
| 4,742,619 | 5/1988 | Swanson | 33/474 |
| 5,090,129 | 2/1992 | Cunningham | 33/481 |
| 5,170,568 | 12/1992 | Wright | 33/480 |
| 5,239,762 | 8/1993 | Grizzell | 33/474 |
| 5,253,426 | 10/1993 | Mosbrucker | 33/476 |
| 5,456,015 | 10/1995 | Butcher et al. | 33/451 |

FOREIGN PATENT DOCUMENTS

| | | | |
|---|---|---|---|
| 2906921 | 9/1980 | Germany | 33/481 |

*Primary Examiner*—Thomas B. Will

[57] ABSTRACT

A multipurpose square (20A) (20B) which performs and simplifies many of the tasks previously accomplished by the use of multiple tools including the framing square, try square, combination square, layout square, and protractor. The square includes indicia in calibrated scales for rafter, angle, and linear measurements. The square has a profile which facilitates the rapid marking of layouts for various standard dimensional construction materials as well as marking cuts for stair stringers and bond timbers. The square is configured to allow it to be "holstered" or carried in the pockets of standard tool aprons so as to be readily accessible to the tradesman.

20 Claims, 5 Drawing Sheets

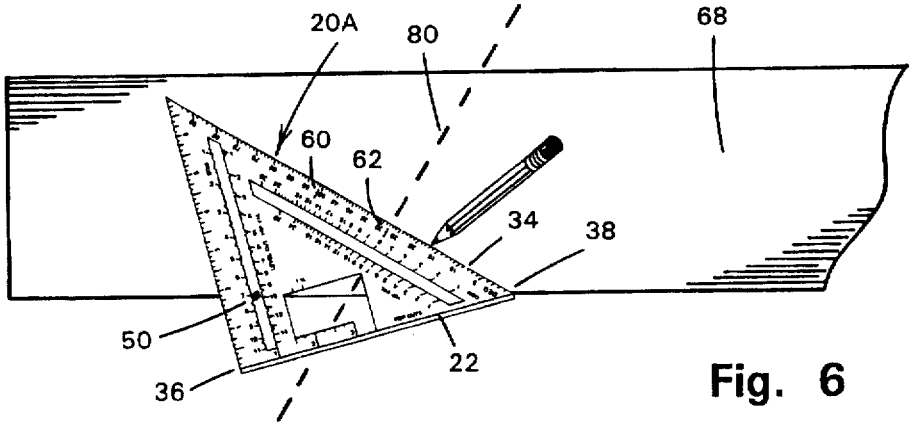
Fig. 6
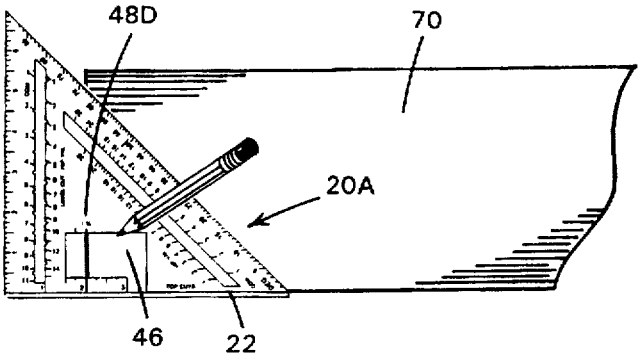
Fig. 7
Fig. 8
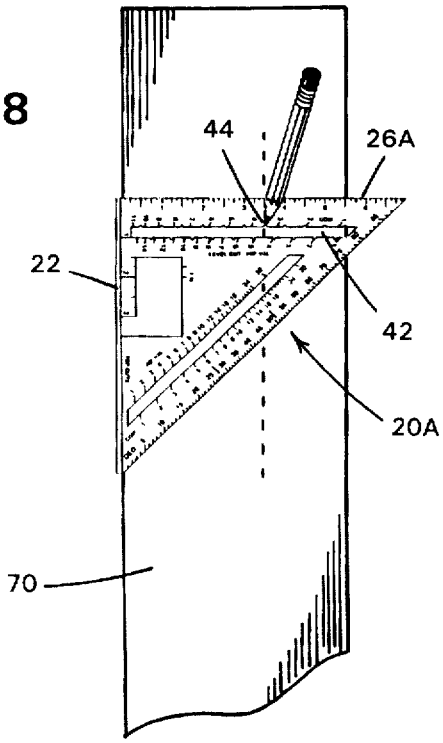

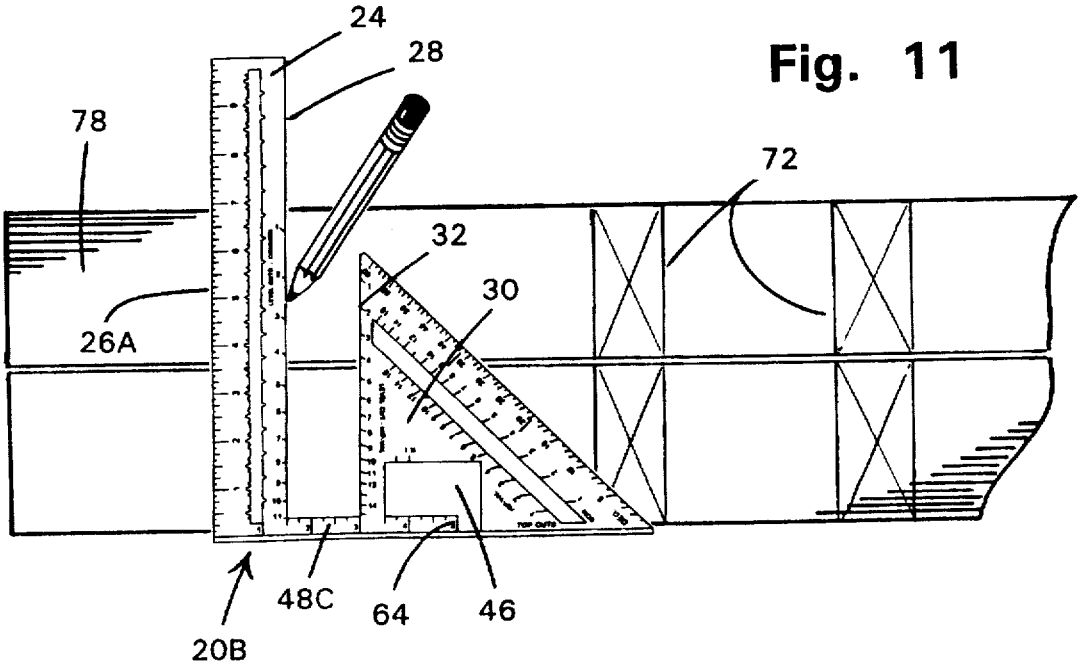
Fig. 11
Fig. 12
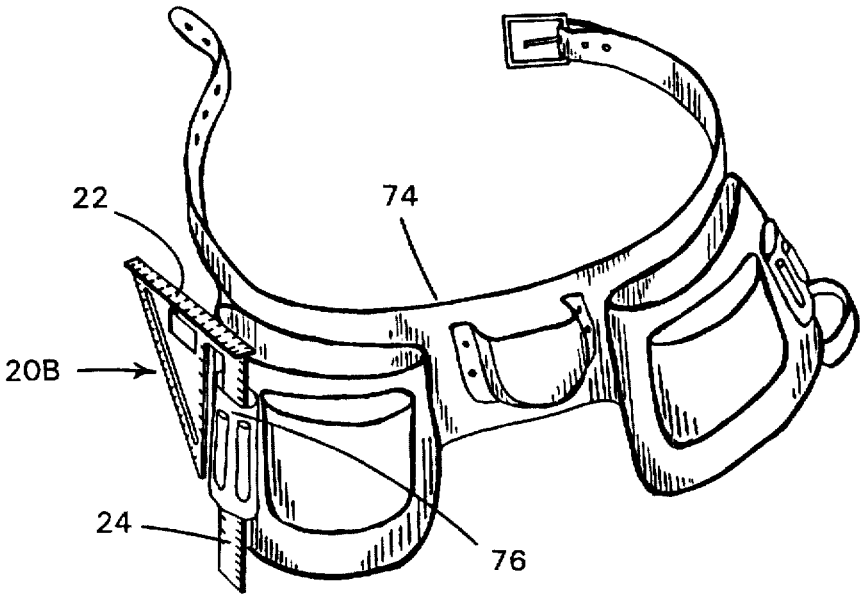

MULTIPURPOSE SQUARE

BACKGROUND

1. Field of the Invention

This invention relates generally to a multipurpose square which performs the functions which traditionally required multiple tools, including the framing square, try square, combination square, layout square, and protractor.

2. Description of the Prior Art

Various devices have been designed in the past to perform different construction layout tasks. The L-shaped framing square is the most universally recognized such tool. It is used to square lumber ends and also to mark the plumb and level cuts for rafters of various pitches. The principle drawback of the framing square is its bulk. The large size permits very accurate marking, but makes it cumbersome to use and impractical to carry. Also its use requires the user to align two marks, one on each leg. This is often a somewhat clumsy operation for after one number is aligned and the other leg is moved to align the second number, it causes the first leg to shift off position making it necessary to align it the second and sometimes a third time.

The combination square is commonly used to mark a line parallel with the edge of a board, but with its use it is necessary to adjust the position of the blade prior to marking a particular line. It is also limited in its ability to accurately mark square lines on wide dimensioned lumber due to the narrow width of the handle.

Various layout squares such as U.S. Pat. No. 5,456,015 to Butcher et al (1995), have been used to layout lines on wall plates and the like at a spacing corresponding to the standard dimensions of various construction materials and components. However, due to their narrow width, they are insufficiently accurate for marking rafter and angle cuts.

Triangular-shaped squares such as U.S. Pat. No. 4,742,619 to Swanson (1988), and U.S. Pat. No. 1,255,425 to Killion (1918) are commonly referred to as "speed squares" because their design allows the marking of rafter cuts and degrees by aligning only one number, whereas the standard framing square requires the alignment of two numbers. The "stop" is held against the edge of the lumber and this holds the tool steady and allows the speedy alignment of the tool. "Speed squares" combine many of the functions of the framing square and the protractor, and are more widely used than any other type of square. They do however have these disadvantages:

1. They are able to readily mark only the plumb cuts of rafters. Marking the level cut of a rafter requires multiple steps:

a) Speed square is used to mark a plumb cut.

b) An imprinted line on the square is visually aligned with the plumb mark.

c) A level cut is marked using the hypotenuse edge of the square.

This process is cumbersome and yields inaccurate results as there is no "stop" to steady the tool against the edge of the lumber when marking the level cut, and the visual alignment of the imprinted reference line with the plumb line yields inaccurate results. When marking the level cut of a rafter's birdsmouth, it is often the case on many sizes of birdsmouths, that there is insufficient length of the plumb mark available to accurately align the square for the marking of the level or seat cut. For example, on flat roof pitches such as 4/12, the birdsmouths plumb cut side is very short in length which makes proper alignment difficult.

2. When marking a square line across wide dimensioned lumber or marking the plumb cut of a steeply pitched rafter, the marking edge of the square is too short to be able to mark all of the way across the lumber.

3. The triangular shape of the square makes them prone to falling out of a tradesman's nail apron. When the tradesman bends or squats down, their wedge shape causes them to "squirt" out of the apron pocket. This is an inconvenience and a workplace safety hazard.

4. Speed squares have only one full edge with linear measurement indicia and therefore cannot perform many of the functions of the framing square which require simultaneous measurement on each of the two legs of the right triangle. An example of such an operation is the layout of the step marks on a stair stringer.

U.S. Pat. No. 5,170,568 to Wright (1992) sought to overcome some of the difficulties of marking a level cut with a "speed square", however the invention as disclosed is unworkable. FIG. 8 of Wright's disclosure shows his speed square being used to mark a plumb cut on a 5/12 pitch rafter. He claims certain advantages afforded by his invention over the prior art illustrated in FIG. 9 of his disclosure. However his square will only perform as claimed on a 5/12 pitch rarer. Using his square in the manner shown in FIG. 8 of his disclosure on any rafter pitch other than 5/12, yields an incorrect and unworkable angle. Wright's invention does allow for the marking of a common rafter level cut, but makes no provision for the marking of a hip/valley afterrarer level cut.

U.S. Pat. No. 4,513,510 to Swanson (1985) discloses a larger configuration of a "speed square" which includes a "layout bar". This is intended to facilitate the marking of stair stringers. The multiple pieces, including layout bar, bolts, nuts, and washers are cumbersome to assemble and adjust. Because the linear measurement indicia is not on the outside of the base edge of the tool but rather on the interior pan of the square, its use is limited to the layout of stairs using the layout bar, and provides little utility for performing many of the other functions of squares which require simultaneous measurement along both edges of the right angle of the square.

SUMMARY

Many prior art squares perform a variety of specialized functions, however none of them are able to execute the broad range of functions required in the performance of many different construction tasks.

OBJECTS AND ADVANTAGES

It is the object of the present invention to overcome the shortcomings of the prior art and the more traditional methods and to provide a multi-purpose square which executes a variety of layout and construction tasks with the minimum amount of manipulation of the tool. It is a further object to provide a tool of a size which enables it to be readily portable and quickly accessed from a pocket of a tradesman's tool apron.

Several objects and advantages are:

1. A tool which can locate marks for the layout of wall plates for studs, corners, T-posts, and the like with the minimum amount of manipulation, measuring, or moving of the tool.

2. A tool which can by the alignment of one number quickly mark the plumb cuts on various pitch common, hip, valley, and jack rafters.

3. A tool which can by the alignment of one number quickly mark the level cuts on various pitch common, hip, valley, and jack rafters.

4. A tool which can by the alignment of one number quickly layout lines of various degrees of pitch.

5. A tool which can be used to scribe parallel lines at various distances from the edges of lumber and the like.

6. A tool which allows a tradesman to quickly "shorten" a rafter to make allowance for the thickness of a ridge board.

7. A tool which provides for the rapid and accurate marking of notches for bond timbers.

8. A tool which allows a tradesman to mark off the steps of a stair stringer member with the least amount of manipulation of the tool.

9. A tool which has indicia to quickly locate the tool for the marking of birdsmouths for 2×4 and 2×6 wall plates.

10. A tool with measurement indicia on multiple edges which allow it to perform a variety of layout and measurement tasks.

11. A tool which is configured and sized to be readily portable and accessible when fit into the pockets or slots of standard tool belts or pouches.

DESCRIPTION OF FIGURES

FIG. 6 Illustrates the tool used to mark the birdsmouth for a 3½" wall plate.

FIG. 7 Illustrates the tool used to mark a notch for a 2×2 bond timber in a floor joist.

FIG. 8 Illustrates the tool used to scribe a line parallel to the edge of a board.

FIG. 11 Illustrates the embodiment of FIG. 9 being used to layout a set of wall plates.

FIG. 12 Illustrates the embodiment of FIG. 9 holstered into the pocket of a tool apron.

DESCRIPTION OF INVENTION

Figure 1:
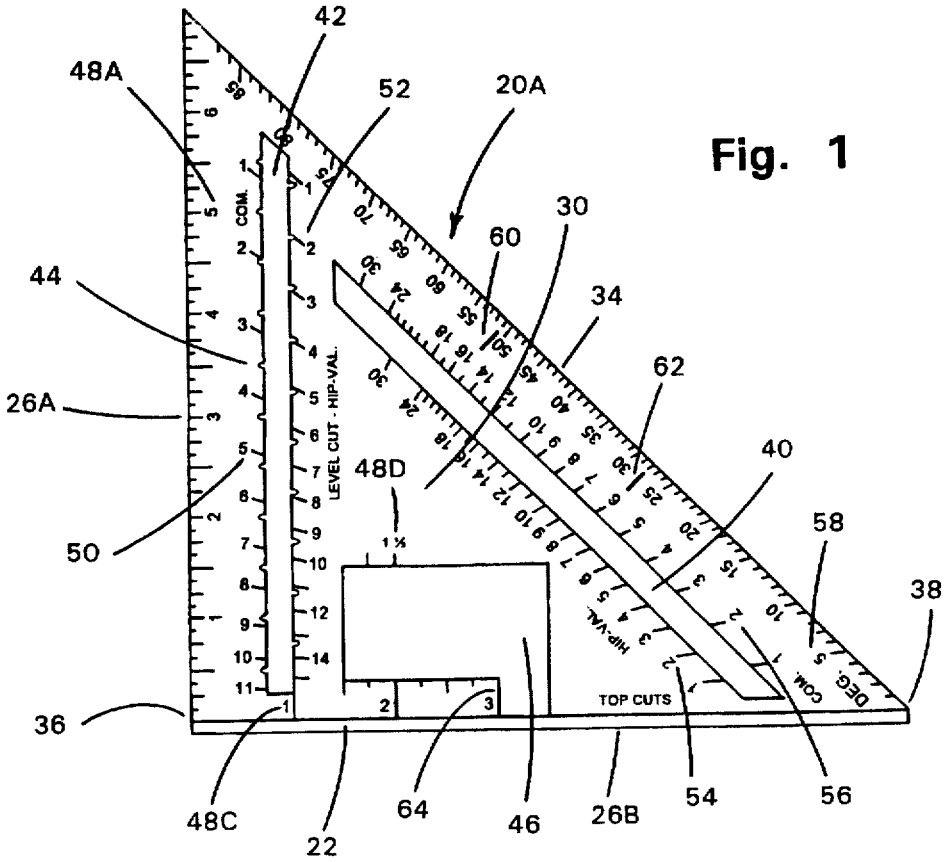
FIG. 1 Shows a side view of one embodiment of the present invention.
Figure 2:
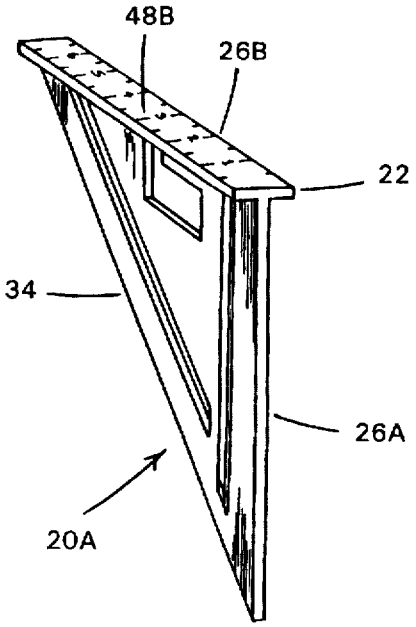
FIG. 2 Is a perspective view of the embodiment of FIG. 1.

A square 20A, one embodiment of the present invention, is illustrated in FIG. 1 (a side view) and FIG. 2 (a perspective view). This tool may be fabricated of any suitable material, but is most commonly made of either steel, die-cast aluminum, or injection molded plastic. The square has two sides with each side a mirror image of the other except with the numerals and text reversed for right reading. A handle 22 has an outside and an inside planar face. The outside face forms a second measurement edge 26B and is marked with handle measurement indicia 48B.

FIG. 1 shows a right triangular shaped body 30 with 45 degree opposite angles extending out from the center axis of inside face of handle 22. Body 30 has a hypotenuse edge 34 and its left edge forms a first measurement edge 26A which is marked with measurement indicia 48A indicating the distance from a first pivot point 36. A plumb cut orifice 40 is positioned parallel with hypotenuse edge 34. Along the outside of plumb cut orifice 40 is common rarer plumb cut indicia 56, and along the opposite edge is hip/valley rafter plumb cut indicia 54. At the left end of handle 22 is first pivot point 36, and at the right end of handle 22 is a second pivot point 38. Extending up from second pivot point 38 along hypotenuse edge 34 is degree indicia 58. A marking orifice 42 is situated parallel with first measurement edge 26A, with its left edge ¾" from first measurement edge 26A. Along the left edge of marking orifice 42 is common rafter level cut indicia 51, and along the right side of marking orifice 42 is hip/valley rafter level cut indicia 52. Situated along both sides of marking orifice 42 are indentations 44 which correspond to increments in measurement indicia 48A. Perpendicular to hypotenuse edge 34 and 3½" up from second pivot point 38 is a 3½" seat cut mark 62. Perpendicular from hypotenuse edge 34 and 5½" up from second pivot point 38 is a 5½" seat cut mark 60. A generally "L-shaped" notch marking orifice 46 is situated between first measurement edge 26A and hypotenuse edge 34 with its longest side parallel with and 1½" distant from the inside face of handle 22. A shoulder 64 is 3" distant from first measurement edge 26A. The left edge of notch marking orifice 46 is 1½" distant from first measurement edge 26A and the right edge of notch marking orifice 46 is 3½" distant from first measurement edge 26A. Parallel with handle 22 and situated between first pivot point 36 and shoulder 64 is inside measurement indicia 48C indicating distances from first measurement edge 26A.

Figure 9:
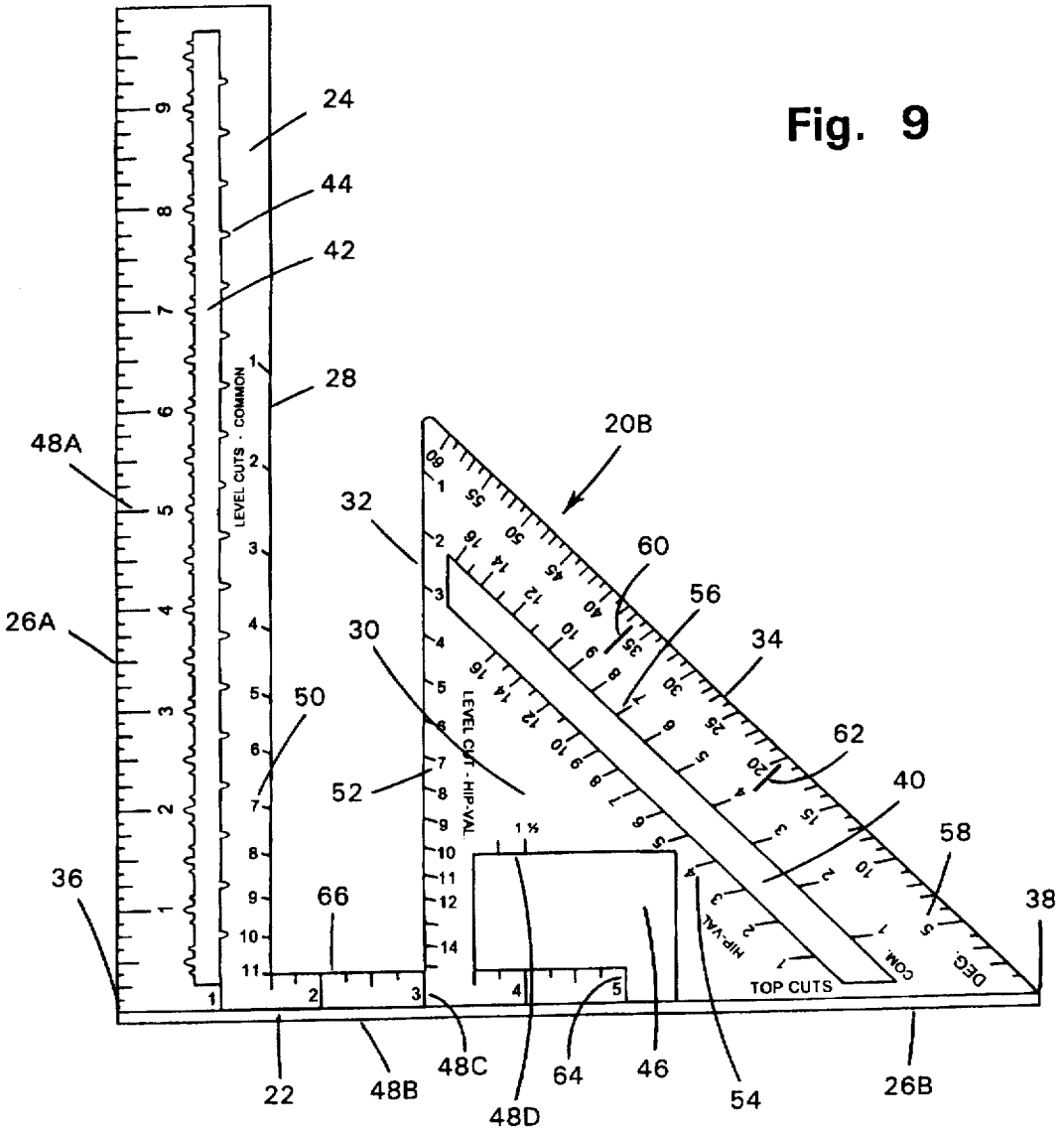
FIG. 9 Illustrates a larger embodiment of the invention (cross section is similar to that shown in FIG. 2)

FIG. 9 shows a square 20B, a larger embodiment of the present invention. It has a similar cross section to that of FIG. 2. It also has two sides with each side a mirror image of the other except with the numerals and text reversed for right reading. Handle 22 has an outside planar face which is approximately 9" in length and marked with handle measurement indicia 48B along its outside face which forms a second measurement edge 26B. At the left end of inside face of handle 22 is first pivot point 36, and at the right end is second pivot point 38. Extending out from the center axis of handle 22 at first pivot point 36 is a tongue 24. The left edge of tongue 24 forms first measurement edge 26A and is marked with measurement indicia 48A. The right edge of tongue 24 forms a first marking edge 28. Parallel with and ¾" distant from first measurement edge 26A is marking orifice 42 which has along its length indentations 44 that correspond with increments in measurement indicia 48A. Distributed along first marking edge 28 is common rafter level cut indicia 50. Tongue 24 is 1½" wide and 10" long. Right triangular shaped body 30 is spaced 1½" from first marking edge 28 and extends out from the center axis of handle 22 coplanar with tongue 24. Body 30 has 45 degree opposite angles and has along its hypotenuse edge degree indicia 58. The left side of body 30 forms a second marking edge 32. Along second marking edge 32 is hip/valley rafter level cut indicia 52. Parallel to hypotenuse edge 34 is plumb cut orifice 40 which has along its outside edge common rafter plumb cut indicia 56. Along the inside edge is the hip/valley rafter plumb cut indicia 54. Situated between second marking edge 32 and plumb cut orifice 40 is a generally "L-shaped" notch marking orifice 46. The top of orifice 46 is parallel with and 1½" distant from the inside face of handle 22. The top edge of orifice 46 is marked with notch measurement indicia 48D. The left edge of orifice 46 is 3½" distant from first measurement edge 26A and ½" distant from second marking edge 32. Shoulder 64 is 5" distant from first measurement edge 26A and right edge of notch marking orifice 46 is 5½" distant from first measurement edge 26A. Coplanar with tongue 24 and body 30 and extending from first marking edge 28 to second marking edge 32 at a height of ½" from handle 22 is a connecting rib 66. Adjacent to handle 22 and extending from first measurement edge 26A to shoulder 64 is inside measurement indicia 48C. Perpendicular to hypotenuse edge 34 and 3½" from second pivot point 38 is 3½" birdsmouth mark 62. Perpendicular to hypotenuse edge 34 and 5½" from second pivot point 38 is 5½" birdsmouth mark 60.

OPERATIONAL DESCRIPTION

Figure 3:
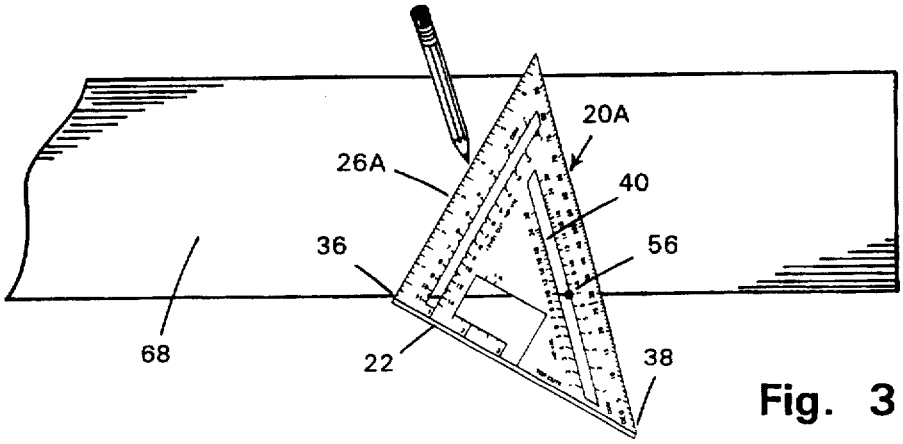
FIG. 3 Illustrates the tool being used to mark the plumb cut of a common rafter.

FIG. 3 shows square 20A, the embodiment of FIGS. 1 and 2, being used to mark a common rafter plumb cut on a rafter 68. This is accomplished by the following steps:

1. The square 20A is laid on rafter 68 with handle 22 at first pivot point 36 pressed against the edge of rafter 68.
2. Second pivot point 38 is moved away from edge of rafter 68 until the desired pitch indicator (7/12) on common rafter plumb cut indicia 56 is aligned with bottom edge of rafter 68.
3. The plumb cut mark is made along first measurement edge 26A.

Figure 4:
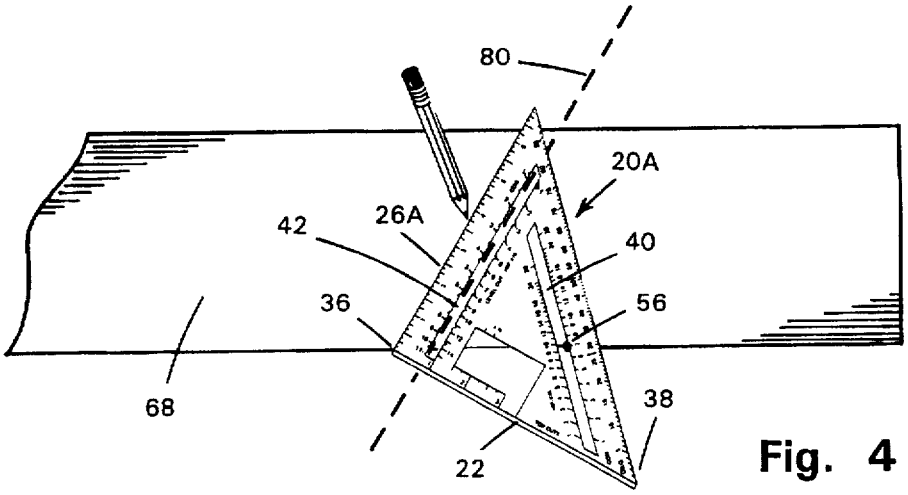
FIG. 4 Illustrates how the tool quickly "shortens" a rafter at a ridge board.

FIG. 4 illustrates how the present invention is used to "shorten" a rafter to make allowance for the thickness of the ridge board. The various methods used by carpenters to ascertain the length of a rafter most often yield a length reaching to the center of the ridge board. It is therefore necessary to "shorten" the rafter to allow for one half of the thickness of the ridge. Since most framing lumber is 1½" thick, this is most commonly ¾". The "shortening" is measured perpendicular to the plumb cut of the rafter. The change in the actual length of the top edge of the rafter will vary depending on the pitch of the rafter. Generally this "shortening" is done by one of two methods:

1. (a) Using a rafter table or a calculator to find the rafter length for the appropriate pitch based on a horizontal run of ¾".
   (b) Measuring down along the top edge of the rafter the calculated distance.
   (c) Marking a new plumb cut.
2. (a) Marking a plumb line at the center line of the ridge.
   (b) Using a square to measure ¾" perpendicular from center line of ridge.
   (c) Marking a new plumb cut in line with the ¾" mark parallel with the center line of the ridge.

The present invention accomplishes the task of "shortening" the rafter in one simple step. The left edge of marking orifice 42 is aligned with a plumb line 80 on rafter 68 and a mark is made along first measurement edge 26A. This produces a new plumb cut line ¾" from and parallel to the center line of the ridge.

Figure 5:
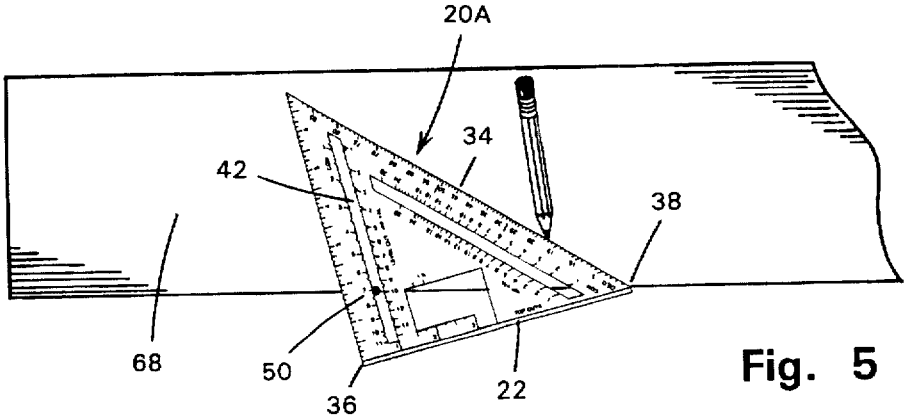
FIG. 5 Illustrates the tool used to make a level cut mark on a common rafter.

FIG. 5 illustrates the marking of a common rafter level cut. Handle 22 at second pivot point 38 is placed against the bottom edge of rafter 68 and first pivot point 36 is rotated away from the edge of rafter 68 until the desired pitch indicator (7/12) on common rafter level cut indicia 50 is aligned with the bottom edge of rafter 68. The level cut is then marked along hypotenuse edge 34.

FIG. 6 illustrates the marking of a rafter birdsmouth with a 3½" seat cut. First plumb line 80 is drawn on the rafter 68 as described in FIG. 3. The square is then pivoted back to mark the level cut as described in FIG. 5. Once in this position, the square is slid parallel to the edge of rafter 68 until 3½" seat cut mark 62 is aligned with plumb line 80. The seat cut of the rafter birdsmouth is then marked along the hypotenuse edge 34. Such a birdsmouth is suitable for use on a 2×4 wall plate. Using the same procedure utilizing the 5½" seat cut mark 60 will give a birdsmouth suitable for a 2×6 wall plate.

FIG. 7 illustrates the marking of a bond timber notch in a joist 70. Handle 22 is pressed against the bottom edge of joist 70 so that the left side of notch marking orifice 46 is aligned with the end of joist 70. The top and right edges of notch marking orifice 46 is used as a guide to mark the bond timber notch. Aligning the end of joist 70 with left edge of notch marking orifice 46 will yield a 2" wide bond notch. If a 1¾" or 1½" bond notch is desired then the end of joist 70 is aligned with the appropriate mark on notch measurement indicia 48D.

FIG. 8 illustrates the present invention employed to scribe a line parallel with the edge of joist 70. Handle 22 is pressed against the left edge of joist 70. A pencil is placed into any of the indentations 44 at the desired distance from handle 22. The square 20A is then slidably moved along the left edge of joist 70 to scribe a line parallel to the edge of joist 70.

Square 20B as shown in FIG. 9 is operated in similar fashion as square 20A of FIG. 1, when performing the functions illustrated in FIGS. 3, 4, 5, 6, 7, and 8. The primary difference is that on the larger embodiment of FIG. 9, the common rafter level cut indicia 50 is situated along the right edge of tongue 24 at first marking edge 28 and the hip/valley rafter level cut indicia 52 is arrayed along second marking edge 32. Square 20B as shown in FIG. 9 can perform all the functions of the embodiment of FIG. 1 and is also suitable for several additional tasks.

Figure 10:
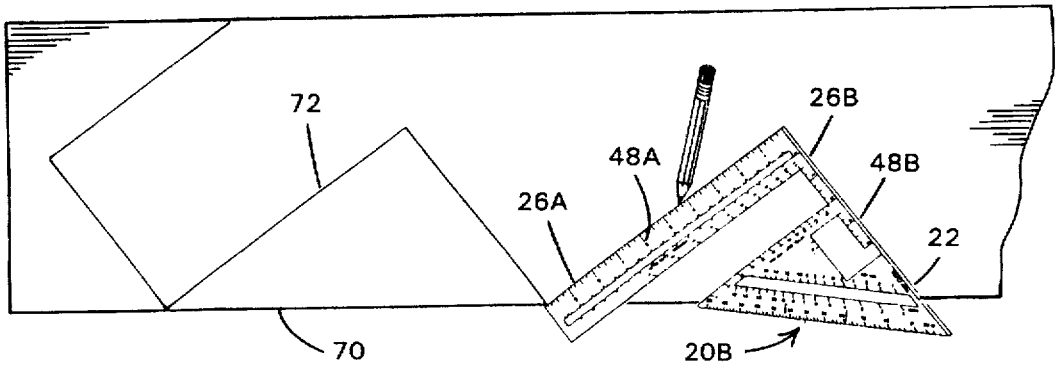
FIG. 10 Illustrates the embodiment of FIG. 9 being used to layout a stair stringer.

FIG. 10 shows square 20B being used to layout a stair stringer. A typical stair will utilize a tread dimension of approximately 10" and a riser dimension of approximately 7½". Because measurement indicia 48A indicates the distance from the inside face of handle 22 and laying out a stair stringer requires measuring from the outside of handle 22, an adjustment needs to be made for the thickness of handle 22 (generally ⅛"). To mark such a stair stringer, the 9⅞" mark of measurement indicia 48A and the 7½" mark of handle measurement indicia 48B are aligned with the bottom edge of joist 70. Marks are then made along first measurement edge 26A and second measurement edge 26B. This procedure is repeated in end-to-end fashion to make layout marks 72 for cutting of stair steps. The edges of handle 22 project out from the faces of body 30 so that body 30 does not lay flat on the surface of joist 70, however it is close enough so that first measurement edge 26A provides an accurate marking edge for marking with a pencil or the like.

FIG. 11 shows square 20B as shown in FIG. 9 being used as a layout square for marking a set of 2×4 wall plates 78. Laying out a set of wall plates requires the user to place a series of layout marks 72 at predetermined spacing, most frequently ¾", 1", 1½", 3", 3½", and 5½" spacing. Square 20B accomplishes this task very efficiently because the spacing of the edges of tongue 24 and second marking edge 32 allow several marks to be made without any movement or manipulation of square 20B. In addition the spacing of shoulder 64 and the edges of notch marking orifice 46 from first measurement edge 26A facilitate the rapid marking of layout marks at 3½", 5", and 5½". Also inside measurement indicia 48C allows the user to easily mark a line at various other distances from first measurement edge 26A.

Square 20B illustrated in FIG. 9 can perform all the functions of the square 20A of FIG. 1, but due to its larger size it is capable of performing many additional tasks which previously required the use of a framing square. Due to its somewhat larger size it is considered by some to be too large to conveniently fit into the pouch of some tool aprons. FIG. 12 illustrates how square 20B is configured to slide into a utility knife pocket 76 of a tool apron 74. Pockets 76 are almost universally included on tool aprons. It is very common for the bottom of such pockets, which are secured by stitching and the like, to be cut by the open blade of a utility knife inserted into the pocket 76. This open bottomed pocket 76 makes a handy holster into which one can slide tongue 24 of square 20B. This situates the tool at the side of the tradesman in "six gun" fashion and makes it very convenient for them to draw it out and replace it in the course of their tasks. In addition to making the tool readily accessible, this arrangement secures the tool from being accidentally dropped, thereby eliminating the safety hazard common to conventional "speed squares" which can readily fall from tool apron pouches.

From the operational description above it becomes evident that the present invention in the embodiments shown, effectively accomplishes many tasks previously requiring the use of the framing square, try square, combination square, speed square, layout square, and protractor, and provides the following advantages:

1. Accurately marks a square line all the way across wide dimensional lumber.

2. In one step accurately marks plumb cuts for all common, hip, valley, and jack rafters even on wide dimensional lumber.

3. With great accuracy and minimum manipulation, marks level cuts for all common, hip, valley, and jack rafters.

4. Quickly and accurately marks notches for bond timbers.

5. Accurately and with the minimum manipulation of the tool makes layout marks on wall plates and the like at various spacings, including the commonly used increments of ¾", 1", 1½", 3", 3½", 5", and 5½".

6. Quickly and accurately determines angles of various degrees.

7. Provides a square large enough to effectively layout stair stringers.

8. Facilitates the rapid marking of birdsmouths suitable for use on a 2×4 or 2×6 wall plate.

9. Facilitates the accurate scribing of a line at various distances from the edge of a board or the like.

10. Allows for the accurate and easy "shortening" of a rarer to allow for ½ of the ridge thickness.

11. Fits into the pockets of standard tool aprons so as to be readily accessible to the tradesman and also to secure the tool from being accidentally dropped.

Although the description above contains many specificities, these should not be construed as limiting the scope of the invention but as merely providing some of the features and uses of the presently preferred embodiments. Many other construction tasks encountered in framing, siding, cornice, trim work, etc. may be effectively executed by embodiments of this tool. Variations in the shape, size, and positioning of the described elements could be used to optimize the tool for a specific construction task. For example the spacing of marking orifice 42 from first measurement edge 26A could be adjusted to correspond with the dimensions of various construction components. Also the spacing of first marking edge 28, second marking edge 32, and the plurality of edges of notch marking orifice 46 could be adjusted to correspond with the standard dimensions of construction components. Therefore the scope of the invention should be determined by the appended claims and their legal equivalents rather than by the examples given.

I claim:

1. A multipurpose square comprising:

an elongate substantially planar handle having a first end, a second end, an inside face, and an outside face;

a right triangular substantially planar body extending out from said inside face, said body having a first measurement edge, a hypotenuse edge, and an axis perpendicular to said inside face, the right angle of said right triangular body being adjacent to said first end;

an elongate plumb cut orifice in said body, said plumb cut orifice having opposite elongate edges generally parallel with said hypotenuse edge;

an elongate marking orifice in said body having opposite elongate edges generally parallel with said first measurement edge;

a first pivot point at the intersection of said first measurement edge and said inside face;

a second pivot point at the intersection of said hypotenuse edge and said inside face;

common rafter plumb cut indicia positioned along one edge of said plumb cut orifice;

hip and valley rafter plumb cut indicia positioned along the opposite edge of said plumb cut orifice;

common rafter level cut indicia positioned along one edge of said marking orifice;

hip and valley rafter level cut indicia positioned along the opposite edge of said marking orifice;

degree indicia positioned along said hypotenuse edge, whereby layout marks may be made in units of degrees.

2. The multipurpose square of claim 1 wherein said marking orifice is disposed from said first measurement edge a first predetermined distance whereby a rafter may be quickly shortened to allow for the thickness of a ridge board.

3. The multipurpose square of claim 1 further comprising a notch marking orifice with a plurality of edges, said notch marking orifice having at least a first edge substantially parallel with said handle and at least a second edge substantially parallel with said first measurement edge, said first edge being spaced approximately 1.5 inches from said inside face, said second edge being disposed between said first edge and said inside face, whereby marks for notches may be easily made on floor joists and the like.

4. The multipurpose square of claim 1 further comprising:

measurement indicia positioned along said first measurement edge;

a plurality of indentations positioned along at least one edge of said marking orifice, said indentations spaced at a distance corresponding to the spacing of said measurement indicia whereby layout marks may be accurately scribed along the length of a joist or the like;

handle measurement indicia positioned along the length of said outside face;

inside measurement indicia positioned along said body adjacent to said handle, whereby certain standardized distances from said first measurement edge may be easily determined and marked.

5. The multipurpose square of claim 1 wherein said body further has means defining at least a first edge substantially parallel with said handle and at least a second edge substantially parallel with said first measurement edge, said first edge being spaced approximately 1.5 inches from said inside face, said second edge being disposed between said first edge and said inside face, whereby marks for notches may be easily made on floor joists and the like.

6. The multipurpose square of claim 4 further comprising:

a 3.5 inch seat cut mark positioned perpendicular from said hypotenuse edge at a distance of approximately 3.5 inches from the intersection of said hypotenuse edge and said inside face;

a 5.5 inch seat cut mark positioned perpendicular from said hypotenuse edge at a distance of approximately 5.5 inches from the intersection of said hypotenuse edge and said inside face.

7. The multipurpose square of claim 3 wherein one edge of said notch marking orifice forms a shoulder, said shoulder being substantially perpendicular to said handle and spaced a first predetermined distance from said first measurement edge, and said second edge of said notch marking orifice spaced a second predetermined distance from said first measurement edge, whereby certain standardized distances may be easily marked for the location of building components and the like.

8. The multipurpose square of claim 7 wherein said second edge of said notch marking orifice is spaced approximately 3.5 inches distant from said first measurement edge, said square further including notch measurement indicia positioned along said first edge of said notch marking orifice.

9. A multipurpose square comprising:

an elongate substantially planar handle having a first end, a second end, an inside face, and an outside face;

an elongate substantially planar tongue having an axis perpendicular to said inside face, said tongue having a first measurement edge and a first marking edge, both said edges being parallel to said axis of said tongue and spaced a first predetermined distance apart, whereby certain standardized distances may be easily marked for the location of building components and the like, said tongue extending away from said inside face so that said first measurement edge intersects with said first end;

a right triangular substantially planar body having an axis perpendicular to said inside face so that said body extends away from said inside face parallel and substantially coplanar with the axis of said tongue, said body having a second marking edge and a hypotenuse edge, said second marking edge being parallel with and spaced from said first marking edge a second predetermined distance, there being a clear space therebetween, whereby certain standardized distances may be easily marked for the location of building components and the like;

a first pivot point at the intersection of said first measurement edge and said inside face;

markings along at least one edge of said body, said markings being spaced from one another at predetermined angular intervals, thereby serving as pitch indicators.

10. The multipurpose square of claim 9 wherein said markings are degree indicia positioned along said hypotenuse edge whereby angular layout marks may be made in units of degrees, said square further comprising:

an elongate plumb cut orifice in said body, said plumb cut orifice having opposite elongate edges generally parallel with said hypotenuse edge;

common rafter plumb cut indicia positioned along one edge of said plumb cut orifice;

hip and valley rafter plumb cut indicia positioned along the opposite edge of said plumb cut orifice;

a second pivot point at the intersection of said hypotenuse edge and said inside face;

common rafter level cut indicia positioned along said first marking edge;

hip and valley rafter level cut indicia positioned along said second marking edge.

11. The multipurpose square of claim 10 further comprising:

measurement indicia positioned along said first measurement edge;

handle measurement indicia positioned along said outside face.

12. The multipurpose square of claim 11 further comprising:

an elongate marking orifice in said tongue, said marking orifice having opposite elongate edges generally parallel with said first measurement edge;

a plurality of indentations positioned along at least one edge of said marking orifice, said indentations spaced at a distance corresponding to the spacing of said measurement indicia whereby layout marks may be accurately scribed along the length of a joist or the like.

13. The multipurpose square of claim 9 further comprising a notch marking orifice in said body, said notch marking orifice having a plurality of edges with at least a first edge substantially parallel with said handle and at least a second edge substantially parallel with said first measurement edge, said first edge being spaced approximately 1.5 inches from said inside face, said second edge being disposed between said first edge and said inside face, whereby marks for notches may be easily made on floor joists and the like.

14. The multipurpose square of claim 13 further including notch measurement indicia positioned along said first edge of said notch marking orifice.

15. The multipurpose square of claim 13 wherein one edge of said notch marking orifice forms a shoulder, said shoulder being substantially perpendicular to said handle and spaced a third predetermined distance from said first measurement edge, and said second edge of said notch marking orifice being spaced a fourth predetermined distance from said first measurement edge, whereby certain standardized distances may be easily marked for the location of building components and the like, said square further including:

a substantially planar connecting rib with an axis perpendicular to said inside face and substantially coplanar with the axis of said tongue, said connecting rib extending from said first marking edge to said second marking edge;

inside measurement indicia positioned along said tongue, said connecting rib, and said body adjacent to said inside face, whereby certain standardized distances from said first measurement edge may be easily determined and marked.

16. The multipurpose square of claim 12 wherein said marking orifice is disposed from said first measurement edge a third predetermined distance whereby a rafter may be quickly shortened to allow for the thickness of a ridge board.

17. The multipurpose square of claim 10 further comprising:

a 3.5 inch seat cut mark positioned perpendicular from said hypotenuse edge approximately 3.5 inches distant from the intersection of said hypotenuse edge and said inside face;

a 5.5 inch seat cut mark positioned perpendicular from said hypotenuse edge approximately 5.5 inches distant from the intersection of said hypotenuse edge and said inside face.

18. A multipurpose square comprising:

an elongate substantially planar handle having a first end, a second end, an inside face, and an outside face;

a right triangular substantially planar body extending out from said inside face, said body having an axis perpendicular to said inside face, and having a first measurement edge, and a hypotenuse edge, the right angle of said right triangular body being adjacent to said first end;

an elongate plumb cut orifice in said body, said plumb cut orifice having opposite elongate edges generally parallel with said hypotenuse edge;

a first pivot point at the intersection of said first measurement edge and said inside face;

common rafter plumb cut indicia positioned along one edge of said plumb cut orifice;

hip and valley rafter plumb cut indicia positioned along the opposite edge of said plumb cut orifice;

degree indicia positioned along said hypotenuse edge, whereby layout marks may be made in units of degrees;

a notch marking orifice in said body with a plurality of edges, said notch marking orifice having at least a first edge substantially parallel with said handle and at least a second edge substantially parallel with said first measurement edge, said first edge being spaced approximately 1.5 inches from said inside face, said second edge being disposed between said first edge and said inside face, whereby marks for notches may be easily made on floor joists and the like.

19. The multipurpose square of claim 18 further comprising:

measurement indicia positioned along said first measurement edge;

handle measurement indicia positioned along said outside face;

inside measurement indicia positioned along said body adjacent to said inside face whereby certain standardized distances from said first measurement edge can be easily determined and marked.

20. The multipurpose square of claim 19 further comprising:

a second pivot point at the intersection of said hypotenuse edge and said inside face;

an elongate marking orifice in said body, said marking orifice having opposite elongate edges substantially parallel with said measurement edge, said marking orifice being disposed from said first measurement edge a first predetermined distance whereby a rarer may be quickly shortened to allow for the thickness of a ridge board;

common rafter level cut indicia positioned along one edge of said marking orifice;

hip and valley rarer level cut indicia positioned along the opposite edge of said marking orifice;

a plurality of indentations positioned along at least one edge of said marking orifice, said indentations spaced at a distance corresponding to the spacing of said measurement indicia whereby layout marks may be accurately scribed along the length of a joist or the like.

* * * * *

UNITED STATES PATENT AND TRADEMARK OFFICE

CERTIFICATE OF CORRECTION

PATENT NO. : 5,727,325
DATED : March 17, 1998
INVENTOR(S) : Barry D. Mussell

It is certified that error appears in the above-identified patent and that said Letters Patent is hereby corrected as shown below:

Column 1,
Line 37, change “speed” to -- SPEED® --.
Lines 43 and 50, change “Speed” to -- SPEED® --.

Column 2,
Line 10, change “Speed” to -- SPEED® --.
Lines 18, 19 and 31, change “speed” to -- SPEED® --.

Column 7,
Lines 11 and 17, change “speed” to -- SPEED® --.

Signed and Sealed this

Twenty-fourth Day of September, 2002

*Attest:*

*Attesting Officer*

JAMES E. ROGAN
*Director of the United States Patent and Trademark Office*